US005950636A

United States Patent [19]

Hickey

[11] Patent Number: 5,950,636

[45] Date of Patent: Sep. 14, 1999

[54] APPARATUS AND METHOD FOR HAIR TREATMENT

[76] Inventor: Nancy A. Hickey, 3695 Power Dr., Carmel, Ind. 46033

[21] Appl. No.: 08/923,104

[22] Filed: Sep. 4, 1997

[51] Int. Cl.[6] ..... A45D 8/40

[52] U.S. Cl. ..... 132/200; 2/174; 132/319

[58] Field of Search ..... 132/212, 270, 132/200, 207, 319, 333; 2/410, 50, 174; 4/520, 521

[56] References Cited

U.S. PATENT DOCUMENTS

| | | | |
|---|---|---|---|
| D. 205,829 | 9/1966 | Gettinger | D3/13 |
| 2,211,184 | 8/1940 | Varell | 2/174 |
| 2,507,396 | 5/1950 | Spiegel . | |
| 2,556,576 | 6/1951 | Carolis . | |
| 2,600,557 | 6/1952 | Marriott . | |
| 2,647,264 | 8/1953 | Hutton | 2/195 |
| 2,684,072 | 7/1954 | Lewis . | |
| 2,775,973 | 1/1957 | McDonough . | |
| 3,040,336 | 6/1962 | Plank | 4/159 |
| 3,265,076 | 8/1966 | Ellis . | |
| 3,327,720 | 6/1967 | Carmony et al. . | |
| 3,750,681 | 8/1973 | Claunch . | |
| 3,929,143 | 12/1975 | Coleman . | |
| 4,605,017 | 8/1986 | Thompson et al. . | |
| 5,099,865 | 3/1992 | Flannery et al. | 132/212 |
| 5,203,358 | 4/1993 | Eytcheson | 132/212 |

*Primary Examiner*—Todd E. Manahan
*Attorney, Agent, or Firm*—Woodard, Emhardt, Naughton Moriarty & McNett

[57] ABSTRACT

A hood and related method for treatment of hair and protection of the face. The hood includes a first end with a protective collar that is sealed by an elastic band around the hairline of the person receiving hair treatment. A flexible bag is attached to the protective collar and contains the person's hair therein. The second end of the bag includes an opening through which the hair treatment specialist can treat the hair with fluids, the bottom of the bag preventing contact of the fluids with the person's neck, shoulders, or back. The opening at the second end permits easy access to the hair during treatment. The second opening of the bag can be closed with a drawstring to permit the treatment fluids to remain in contact with the person's hair.

6 Claims, 5 Drawing Sheets

APPARATUS AND METHOD FOR HAIR TREATMENT

BACKGROUND OF THE INVENTION

The present invention relates generally to hair treatment aids and more particularly to protective hoods for treatment of hair and protection of the face.

There are many processes associated with the grooming of human hair which require treating the hair with some type of fluid. Examples of such processes include the application of fluids for a permanent, shampooing, coloring and hot oil. Because the types of fluids used can stain clothing or cause discomfort to the person receiving the treatment, it is desireable to provide a means of isolating the scalp area from the area below the hairline.

Various types of devices have been advanced for isolating hair undergoing treatment from the skin below the hairline. Many of these employ a flexible hood that fits loosely around the hair and some means of sealing around the hairline, such as an elastic strap or adhesive tape. These designs also employ various types of openings in the hood through which treatment can be applied. These openings may be secured with zippers or snaps. Examples of these designs include U.S. Pat. No. 5,203,358 issued to Eytcheson, U.S. Pat. No. 3,040,336 issued to Plank, and U.S. Pat. No. 5,099,865 issued to Flannery et al. These designs all have the drawbacks of having hoods with complex shapes or incorporating expensive fasteners.

Yet another design for application of treatment to hair involves a close-fitting cap with a double-walled construction. The treatment fluid is introduced through the cap into the space between the double walls, and is later massaged into the hair. U.S. Pat. No. 2,507,386 issued to Spiegel has these features. The close-fitting nature of this apparatus does not permit the treatment specialist to easily manipulate the hair once the apparatus is installed on the head. In addition, the double-walled nature of the apparatus necessarily increases its expense. Other types of hoods and headbands have been advanced for use by a person while applying makeup. These devices may be of relatively simple shape, and serve more to isolate the skin for treatment rather than the hair for treatment. Examples of such devices include U.S. Pat. No. 2,211,184 issued to Varell and 205,829 (Des.) issued to Gettinger. These devices illustrate relatively simple, inexpensive designs, but lack either access room for the treatment specialist's hands, or sufficient means of closure to maintain treatment fluid in contact with the hair.

What is needed then is a device for treatment of hair that overcomes the disadvantages of the related art of complex construction, inadequate access by the specialist during treatment, or inadequate means of closure.

SUMMARY OF THE INVENTION

The present invention concerns a hood for attachment to a person's head about the hairline to facilitate treatment of the person's hair and protection of the person's face. One aspect of this invention concerns a flexible bag whose shape is either generally frustoconical or generally cylindrical. The bag has opposing ends, and openings at each end. The first end includes a means for sealing the bag about a person's head with the person's hair being received through the first opening. The second end includes a means for closure of the bag at the second end, the closure means being for selectively closing the second opening. Closure of the second opening permits the bag to retain treatment fluid. In another aspect of the invention, the sealing means is an elastic band that is continuous around the first end. In another aspect of this invention, the closure means is a drawstring. Yet another aspect of this invention is a protective collar attached to the first end that limits splashing or leaking of treatment fluid onto the face or body of the person receiving the treatment.

Another aspect of this invention concerns a flexible bag with opposing ends and having a first opening at the first end and a second opening at the second end. The bag has no other opening between the first end and the second end, being essentially continuous but not necessarily seamless.

Another aspect of the present invention concerns a method for treating hair. The method includes the step of providing a flexible hair treatment hood. The hood comprises a bag with opposing ends, and having a first opening at the first end and a second opening at the second end, an interior, a means for sealing at the first end, and a means for closure at the second end. The first opening is sealed around the hairline with the hair being received within the interior of the bag. The hair is then treated with a fluid, and the bag may be closed at the second opening to retain the fluid in contact with the hair. The bag may also be reopened at the second end to reaccess the hair. The second opening can also be positioned into a fluid run-off which collects fluid draining from the hair.

It is an object of the present invention to provide a hood for treatment of hair and protection of the face that is compatible with various treatments used by hair treatment specialists.

It is another object of the present invention to provide a hood for treatment of hair and protection of the face that is simple enough to be inexpensive to produce.

These and other features and advantages will be apparent from the following description of the preferred embodiment of the invention.

DESCRIPTION OF THE PREFERRED EMBODIMENT

Figure 1:
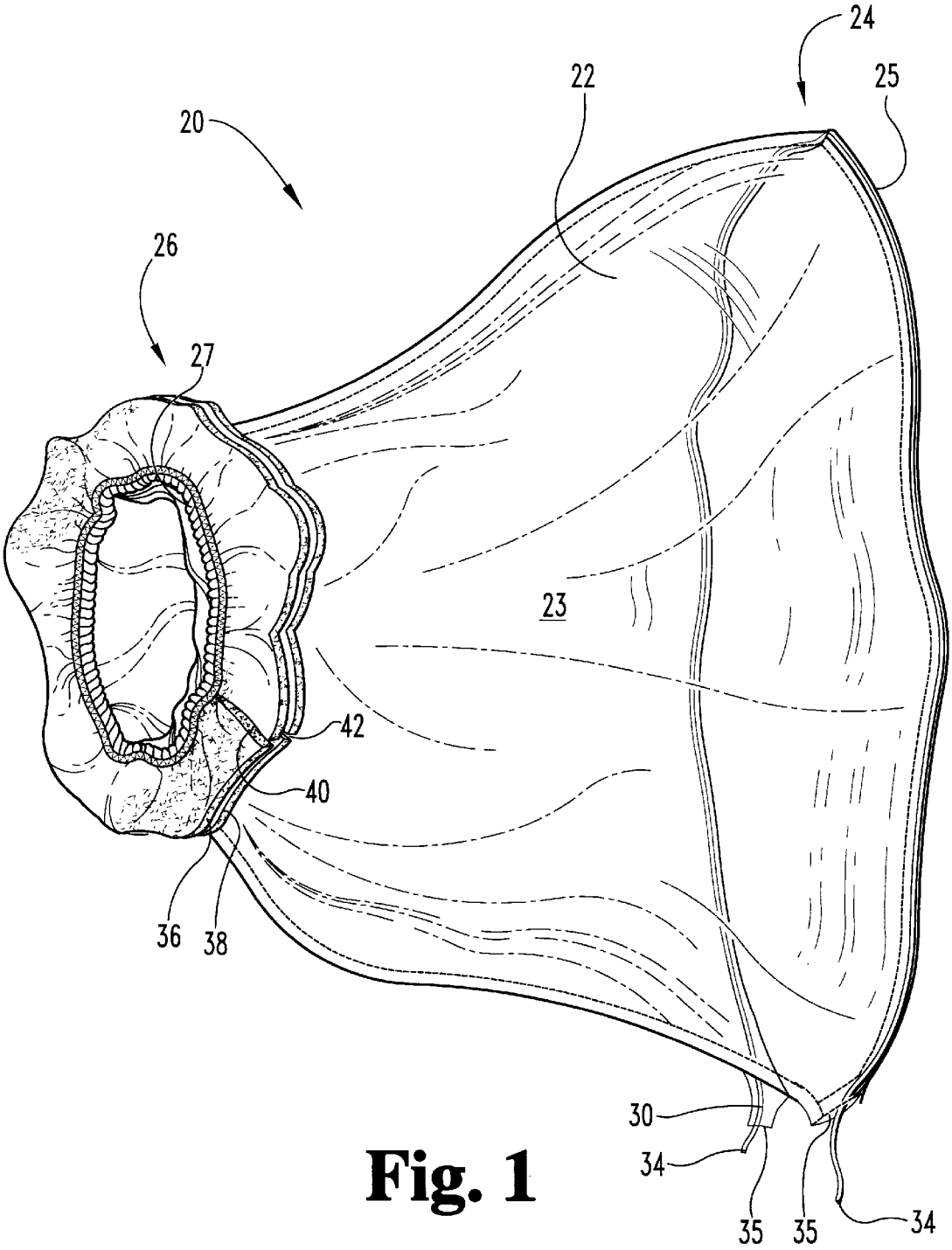
FIG. 1 is a view of the preferred embodiment of the present invention from a front and side perspective.
Figure 2:
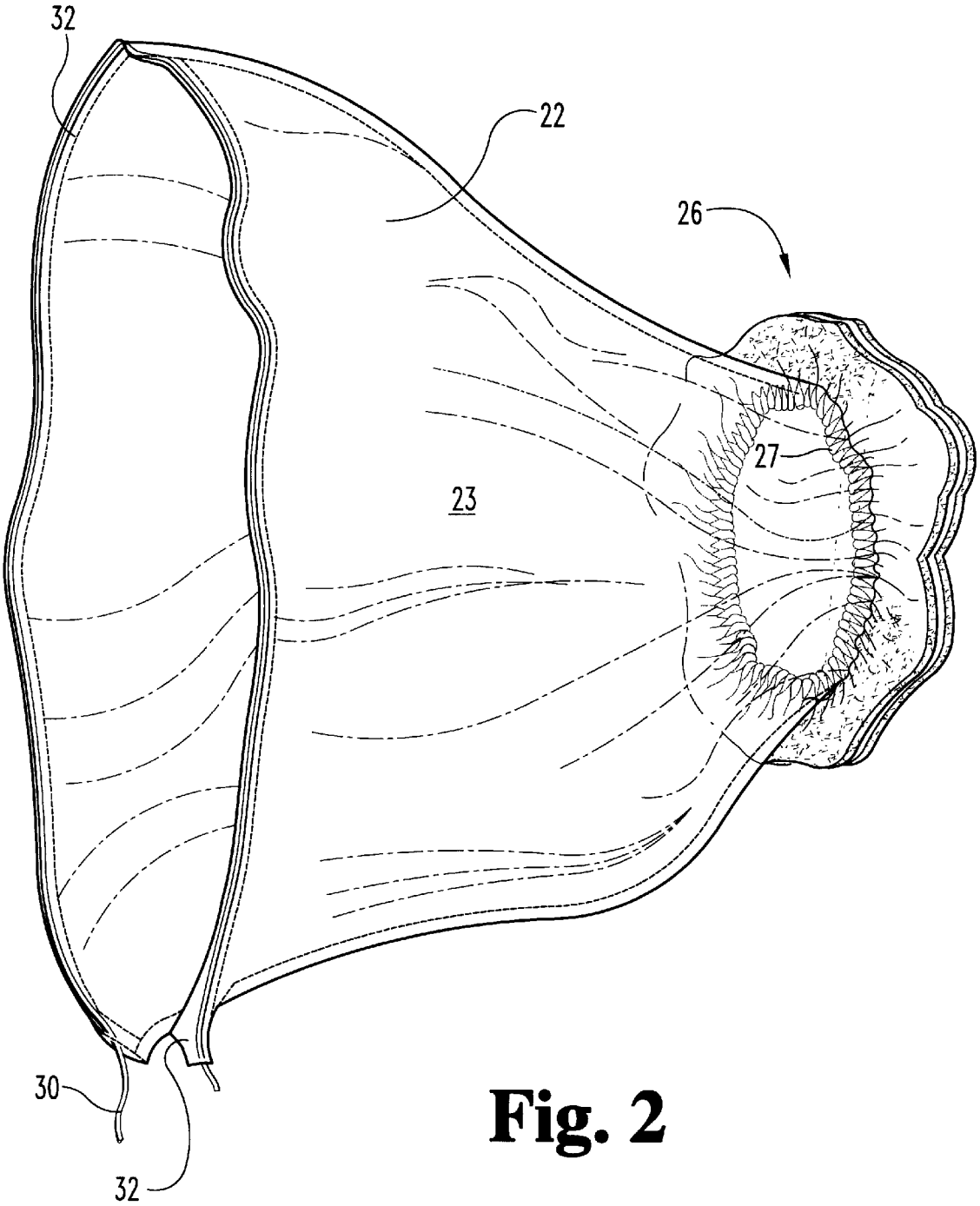
FIG. 2 is a view of the preferred embodiment of the present invention from a rear and side perspective.
Figure 3:
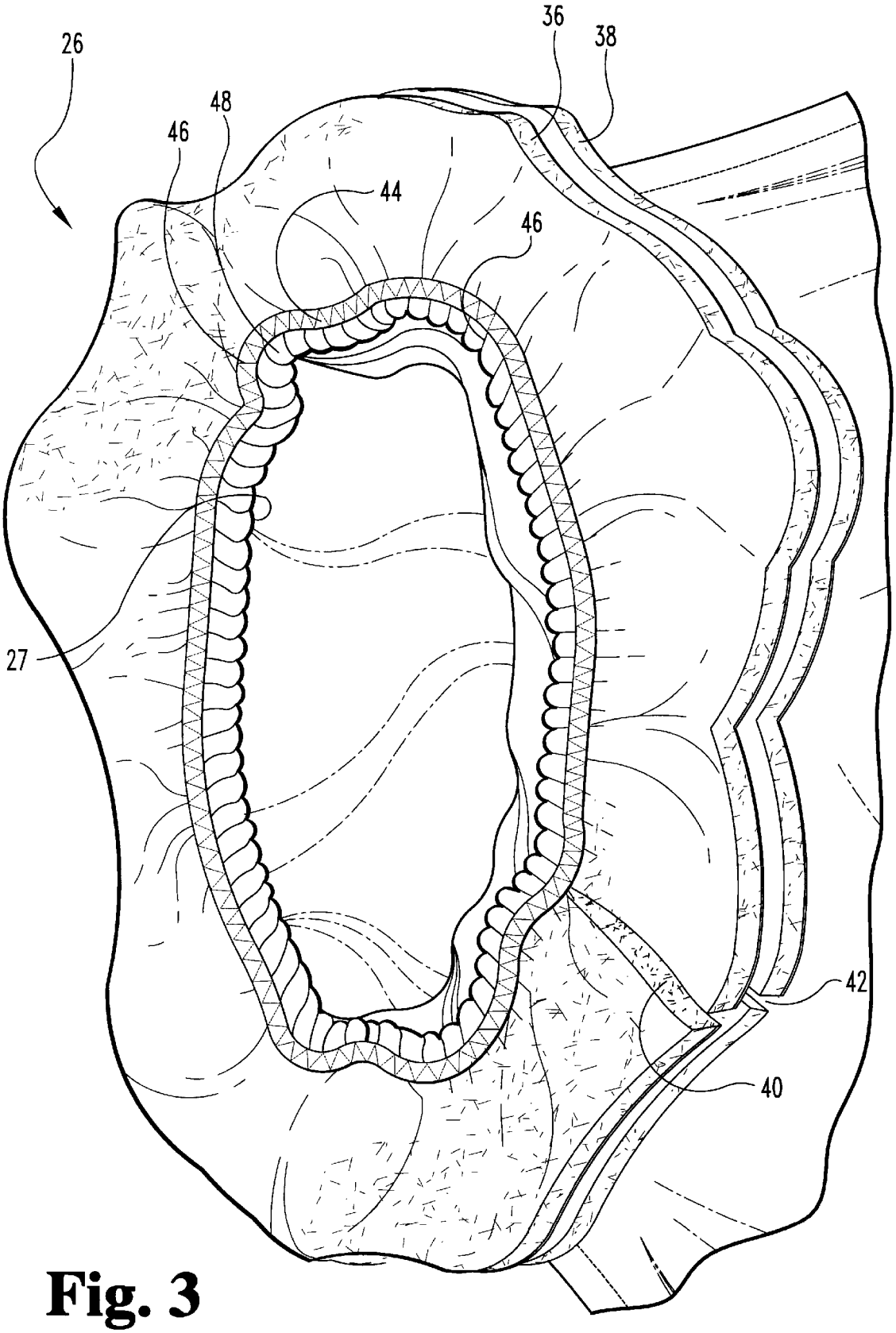
FIG. 3 is an expanded view of FIG. 1 in the vicinity of the collared area.
Figure 4:
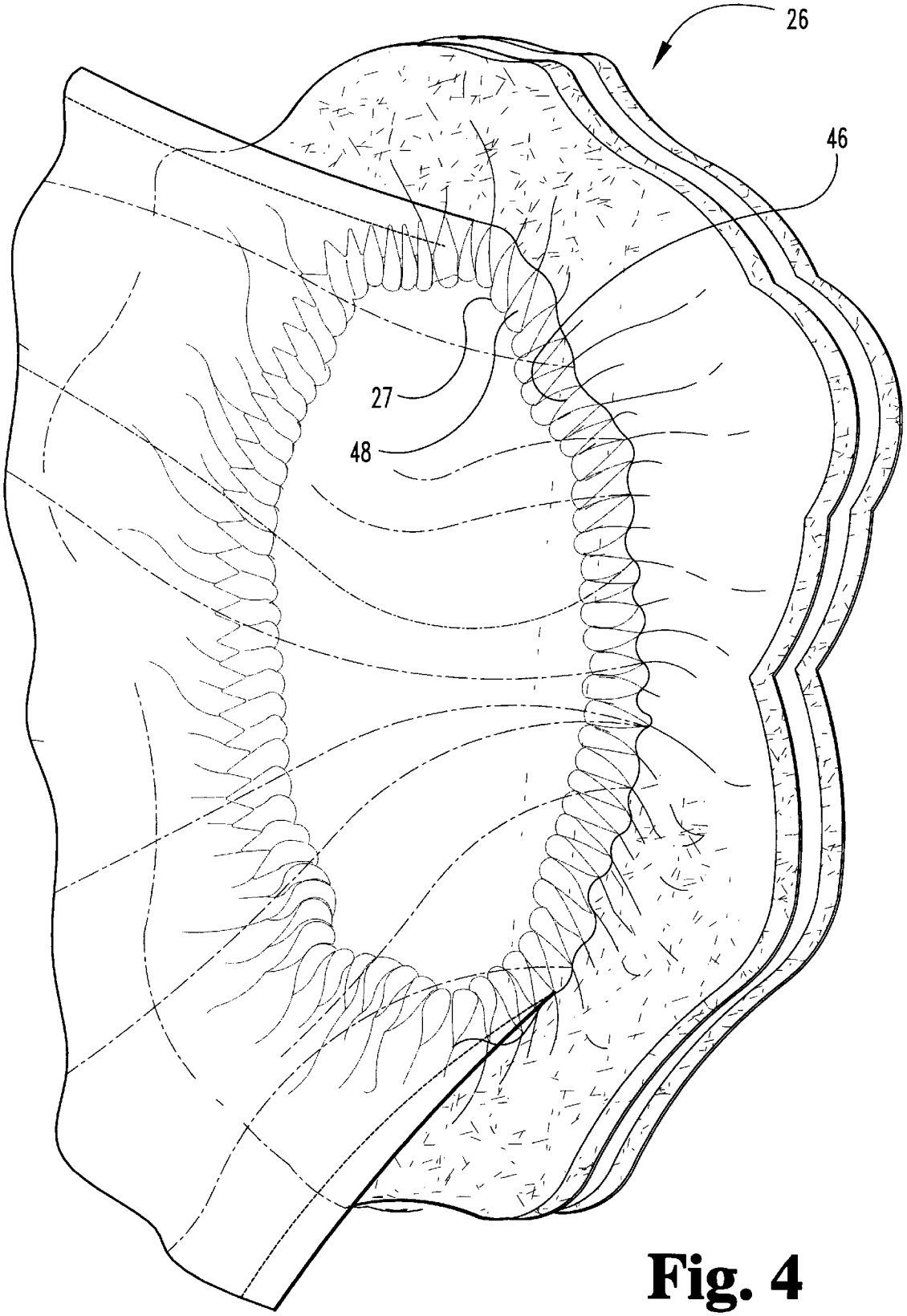
FIG. 4 is an expanded view of FIG. 2 in the vicinity of the collared area.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The preferred embodiment of the present invention provides a hood for treatment of hair and protection of the face during the treatment. A soft, wide protective collar of fabric is placed around the hairline of the person undergoing treatment. A thin, flexible bag covers the person's hair. The bag has a large opening that permits the treatment specialist to easily treat all portions of the person's hair while the hood is being worn. The bag is large enough and flexible enough to permit its bottom-most portion to be placed in a fluid run-off so as to prevent contact of the treatment solution with the person's back, while at the same time permitting the top-most part to be folded back to permit easy access to the person's hair. When the specialist no longer requires access to the hair, the large opening of the bag can be closed by means such as a drawstring to permit the treatment fluid to remain in contact with the person's hair. The hair may be reaccessed by loosening the drawstring. As a result of the types of materials chosen and overall simplicity of the design, the present invention provides the advantages discussed herein at an economical cost, permitting the hood to be disposable after a single use, therefore eliminating all sanitary concerns.

FIGS. 1–5 depict hood 20, the preferred embodiment of the present invention. Hood 20 includes bag 22, which has a generally conical shape or generally cylindrical shape, with opposing ends 26 and 24. The bag defines a first opening 27 located at first end 26, and defines a second opening 25 located at second end 24.

In the preferred embodiment, bag 22 is fabricated from a thin, flexible, transparent plastic material which is tough enough for use in treating hair, including suitable resistance to the types of chemicals used in such treatments. Between first end 26 and second end 24, bag 22 is generally continuous, with no other openings defined therein for access to the person's hair. Bag 22 may include one or more seams if required for ease of construction. Bag 22 defines interior 23, in which the person's hair is placed and treatment is performed.

Second end 24 of hood 20 includes a means for closing second opening 25. In the preferred embodiment, drawstring 30 is placed within fold 32. Fold 32 defines a volume through which drawstring 30 passes. Fold 32 may be formed by taking the edge of bag 22 at second end 24, folding a small portion of it back against bag 22, and sealing the edge to the bag. Drawstring 30 passes freely within fold 32, with ends 34 protruding past fold openings 35. Ends 34 may be pulled tightly to close second opening 25. Opening 25 may be reopened by pulling apart sections of opening 25. Although a drawstring has been described for closing second opening 25, a zipper, velcro, or other means known to those of ordinary skill in the art may be used. Also, the drawstring could be altered to have pairs of free ends on opposite sides of the bag.

Figure 5:
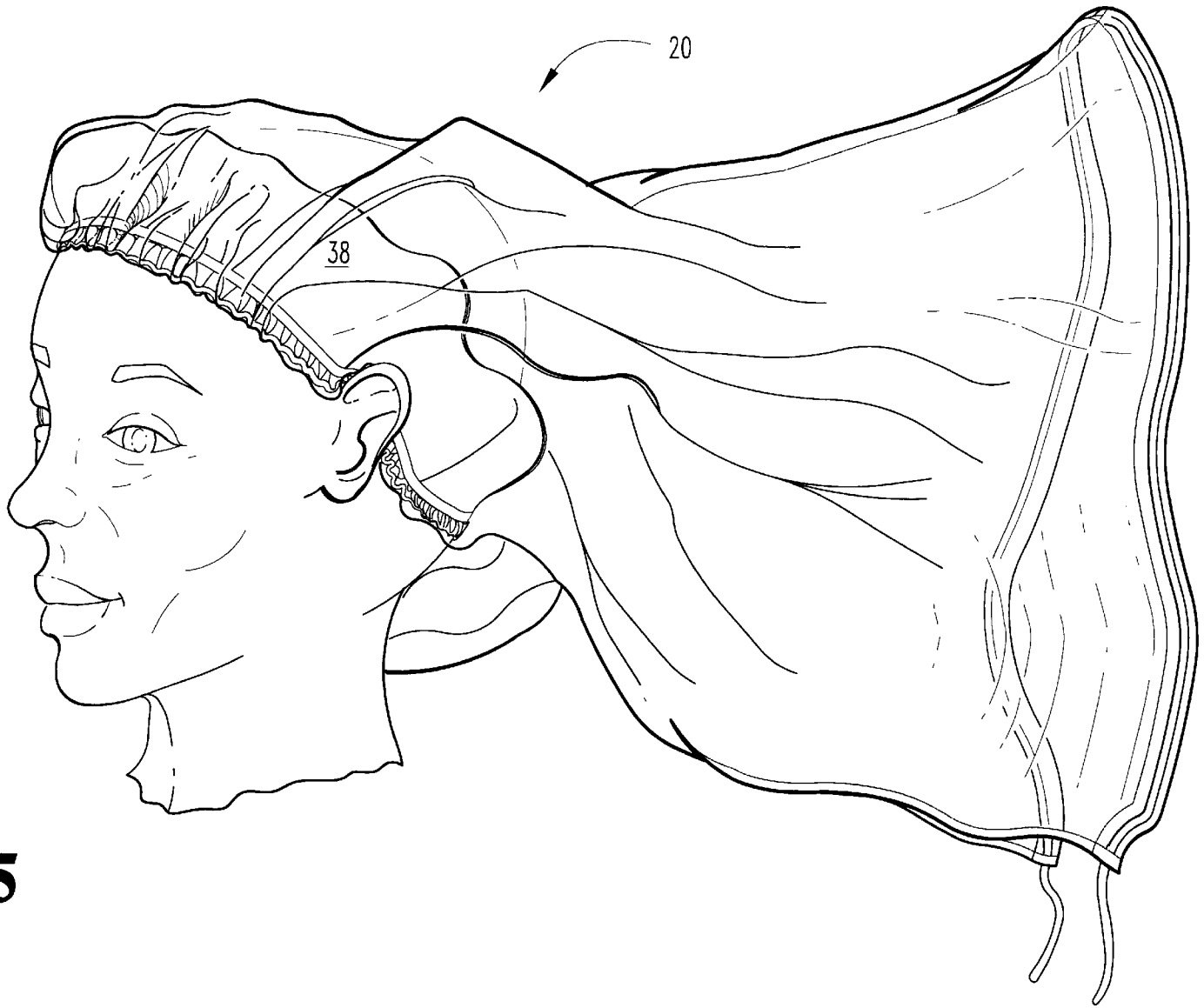
FIG. 5 depicts hood 20 as worn by a person.

First end 26 includes first opening 27 which is placed around the scalp or hairline of the person receiving treatment. Protective collars 36 and 38 are attached to first end 26 by stitching 46. Collars 36 and 38 are shown with split openings 40 and 42, respectively. Stitching 46 is performed so as to place first end 26 of bag 22 and a portion of collars 36 and 38 into small, multiple gathers 48 located generally around first opening 27. Stitching 46 also attaches elastic band 44 to gathers 48, such that first opening 27 may be elastically expanded to fit around the person's hairline. FIG. 5 depicts hood 20 being worn by a person. Elastic band 46 provides continuous elasticity around first opening 27. Once in place, elastic band 44 elastically retracts to a more closed position, thus providing a means for sealing bag 22 and collars 36 and 38 against the person's hairline between the head and the bag. Although the means for sealing against the person's hairline includes elastic band 46, it would also be possible to incorporate other means commonly known in the art, such as a drawstring. Also, whereas the protective collar is shown as comprising two plies 36 and 38, the collar may equally be comprised of a single ply 36, or additional plies.

The present invention also includes a method for attachment of a hood to a person's head about the hairline and treatment of the person's hair. As depicted in FIG. 5, first end 26 is placed around the scalp or hairline of the person's head. Elastic band 44 provides a means for sealing first end 26 around the hairline. Protective collars 36 and 38 protect the person's face during the treatment. The person's hair is placed within interior 23 of bag 22. The hair treatment specialist has access to the person's hair through second opening 25 of second end 24. Various hair treatment chemicals are brought into contact with the hair. Some of these chemicals may drain off of the hair, in which case second end 24 may be positioned into an appropriate fluid run-off device, such as a pan or a sink. If desirable, the hair treatment specialist may then close the second opening to retain the treatment fluid in contact with the hair by pulling ends 34 of drawstring 30. Second opening 25 thus closes, and the treatment chemicals remain in contact with the hair. Hood 20 permits reaccess to the person's hair by pulling open second opening 25, thus pulling drawstring 34 back within fold 32. After reopening second end 25, the hair treatment specialist may permit the fluids in contact with the hair to drain into the run-off. It is also possible to rinse off the treatment fluid with another fluid, and during the rinsing process, the treatment bag can be left on the head and if additional fluids are required, the same bag is suitable. Yet additional treatment fluids could be applied, if necessary.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A hood for attachment to a person's head about the hairline to facilitate treatment of the person's hair and protection of the person's face comprising:

a flexible, fluid retaining bag having a generally frustoconical or generally cylindrical shape and defining opposing first and second ends, said bag defining a first opening at the first end sized to receive a person's head and a second opening at the second end, said second opening having an open position and being sized to permit access to the hair for application of hair treatment chemicals when in the open position, said second opening having a closed position in which hair treatment chemicals are retained within said bag;

a means for sealing attached to said bag at the first end, said sealing means being for sealing said bag about a person's head with the person's hair received through the first opening, said sealing means comprising an elastic band; and a means for closure attached to said bag at the second end, said closure means being for permitting selective closing and opening of the second opening between the closed and open positions, said closure means comprising a drawstring.

2. The invention of claim 1 further comprising a protective collar attached to said bag at the first end surrounding the first opening.

3. The invention of claim 2 wherein said collar comprises two plies.

4. The invention of claim 3 wherein said elastic band is continuous around said first opening.

5. A method for treating a person's hair and protecting a person's face, said method comprising the following steps:

(a) providing a flexible, fluid retaining hair treatment hood comprising a bag with opposing first and second ends, the bag having a generally frustoconical or generally cylindrical shape, the bag defining a first opening at the first end sized to receive a person's head and a second opening at the second end sized to permit access to the hair for application of hair treatment chemicals, said second opening having an open position and being sized to permit access to the hair for application of hair treatment chemicals when in the open position, said second opening having a closed position in which hair treatment chemicals are retained within said bag, the bag defining an interior, the bag including a means for sealing attached to the first end for sealing the bag about a person's head with the person's hair received through the first opening, the sealing means comprising an elastic band, and the bag including a means for closure attached to the second end for permitting selective closing and opening of the second opening between the closed and open positions, said closure means comprising a drawstring;

(b) sealing the first end around the hairline of a person's head;

(c) placing the person's hair within the interior of the bag;

(d) treating the hair with a fluid applied through the second opening; and (e) closing the second opening to retain the fluid in contact with the hair.

6. The method of claim 5 which further comprises the step of reopening the second opening to further treat the hair after said closing step.

* * * * *